United States Patent [19]

Tumbusch

[11] 4,132,972

[45] Jan. 2, 1979

[54] MINIATURE RECTANGULAR POTENTIOMETER WITH A SPRING COMPRESSION CLUTCH

[75] Inventor: Edward H. Tumbusch, Sepulveda, Calif.

[73] Assignee: Techno-Components Corp., Van Nuys, Calif.

[21] Appl. No.: 825,442

[22] Filed: Aug. 17, 1977

Related U.S. Application Data

[63] Continuation-in-part of Ser. No. 707,824, Jul. 22, 1976, abandoned.

[51] Int. Cl.[2] ..... H01C 10/42

[52] U.S. Cl. ..... 338/180; 338/183; 338/DIG. 1

[58] Field of Search ..... 338/174, 180–183, 338/DIG. 1; 174/173

[56] References Cited

U.S. PATENT DOCUMENTS

| | | | |
|---|---|---|---|
| 3,416,119 | 12/1968 | Van Benthuysen | 338/174 |
| 3,597,719 | 8/1971 | Martin et al. | 338/183 |

*Primary Examiner*—C. L. Albritton

*Attorney, Agent, or Firm*—Spensley, Horn & Lubitz

[57] ABSTRACT

A miniature or subminiature, rectangular potentiometer which automatically disengages and engages at the extreme end settings may be fabricated by using a worm screw which engages and disengages a sector gear. The sector gear is arranged and configured to selectively engage a spring at the extremes of travel of the sector gear. When the worm screw drives the sector gear to the limit of its travel, the spring is compressed against the gear thereby compressing the spring. The compression of the spring is sufficient to permit the gear teeth on the opposing end of the sector gear to advance and disengage from the worm screw. Rotation of the worm screw in the opposing direction automatically re-engages the sector gear by virture of the urging of the spring.

7 Claims, 8 Drawing Figures

MINIATURE RECTANGULAR POTENTIOMETER WITH A SPRING COMPRESSION CLUTCH

This application in part discloses and claims subject matter disclosed in my earlier application Ser. No. 707,824 filed July 22, 1976 now abandoned in favor of this copending application.

BACKGROUND OF THE INVENTION

1. Field of the Invention and more particularly, to miniature or subminiature rectangular potentiometers.

2. Prior Art

The size and cost of both active and passive components of electronic circuits have continued to decrease over the last few years. The cost and size of active electronic components and circuitry, such as, integrated circuits, have decreased to such an extent that a major fraction of the cost and space of a circuit is being assumed by other discrete components such as resistors, capacitors, potentiometers, and the like. The past years have witnessed an increasing effort to miniaturize and lower the cost of discrete components because of the cost and size limitations which these components have assumed with respect to overall electronic circuits.

The most difficult of all discrete components to miniaturize have been potentiometers. Numerous integrated circuit and thin film techniques exist by which capacitors and resistors may be miniaturized. Substantial effort has also been devoted to decrease the size and cost, and increase the reliability of discrete potentiometers. See, for example, U.S. Pat. No. 3,683,308 assigned to the same assignee of the present invention.

In many applications, a rectangular miniature potentiometer obtains size advantages over prior art square potentiometers. For example, rectangular potentiometers are typically employed in banks at the edge of a circuit card in order to facilitate adjustment of the circuitry on the card while the card is plugged into a chassis. The number of potentiometers which may be employed on any card or arranged along the edge of a card in a bank is limited by the geometrical configuration of the potentiometers. Clearly, long thin rectangular potentiometers are more adaptable to this type of application than sqaure potentiometers. However, such prior art potentiometers have tended to have complicated designs and to involve the assembly of a great number of exceedingly small parts. The tolerances of the parts involved becomes relatively large so that the accuracy and reliability of the finished potentiometer is diminished. Furthermore, prior art potentiometers have included positive stops which limit the rotation of the adjustment screw at the extreme settings of the potentiometer. Because of the small size of the components in a miniature potentiometer, the slightest rough handling or stress applied to the wiper against the stop could deform the wiper, destroy the operability of the potentiometer or impair its reliability. Therefore, what is needed is a highly reliable, small and low cost miniature rectangular potentiometer which at the same time is rugged.

BRIEF SUMMARY OF THE INVENTION

The present invention is a potentiometer which is comprised of a housing, resistance element, conductive element, elongated screw, sector gear and a conductive wiper. The resistance element and conductive elements are disposed within the housing. Furthermore, an elongated screw is rotatably disposed within the same housing. A sector gear is also slideably disposed in the housing along an arcuate path and is adapted to engage the elongated screw. A conductive wiper is fixed to the resilient sector gear and is in sliding contact with the resistance and conductive elements. A resilient spring is disposed in the housing and engages the sector gear at the extremes of its travel to urge the sector gear back into engagement with the elongated screw. By virtue of the resilience of the spring, the spring may be selectively deformed at the extreme positions of the potentiometer settings by engagement with the sector gear so as to urge re-engagement with the elongated screw.

The present invention is also characterized by a conductive wiper which is fabricated of an integral piece of metal and includes a conductive member and a plurality of interdigitated opposing fingers. The conductive member is in slideable contact with the conductive element. Each of the plurality of interdigitated opposing fingers corresponds to an oppositely disposed finger and is in slideable contact with the resistive element. The elastic compression of the conductive member and fingers hold the conductive member and fingers in a functional disposition within the potentiometer.

Thus, a miniaturized, rectangular potentiometer fabricated according to the present invention is rugged, reliable may be made small in size and low in cost and contains no positive stops by which stress would be transmitted to the conductive wiper. The interdigitated opposing relationship of the fingers of the wiper provide for even and uniform contact with the resistance element regardless of the direction in which the wiper is translated or rotated.

DETAILED DESCRIPTION OF THE PREFERRED EMBODIMENTS

The present invention is a novel and unique miniature or subminiature, rectangular potentiometer which is particularly characterized by a worm screw drive engaging a sector gear and spring combination. The sector gear is arranged and configured so as to be operable within the potentiometer housing as a compression clutch so as to selectively disengage the sector gear from the worm screw drive at the extreme settings of the potentiometer. When in the extreme positions the sector gear engages or touches the spring, thereby compressing it. The spring urges the sector gear into re-engagement with the elongated screw. The potentiometer of the present invention exhibits: very low backlash; substantially no lead lag; an insulated adjustment screw;

an improved multifinger wiper which is characterized by low contact noise and uniform mechanical action in each direction of traversal; and a racheting, compression clutch which automatically engages and disengages the resilient sector gear and avoids the imposition of any stress upon the wiper. The use of a separate spring to urge the gear into re-engagement permits a device with substantially greater lifetimes over an embodiment which employs a resilient gear. In addition, translation of the sector gear along an arcuate path provides for smooth action and a longer resistance track in a compressed space than a linear track. Each of these advantages is obtained in a small, highly reliable and simple design, the details of which may be appreciated and understood in greater detail in connection with each of the figures as described below.

Figure 1A:
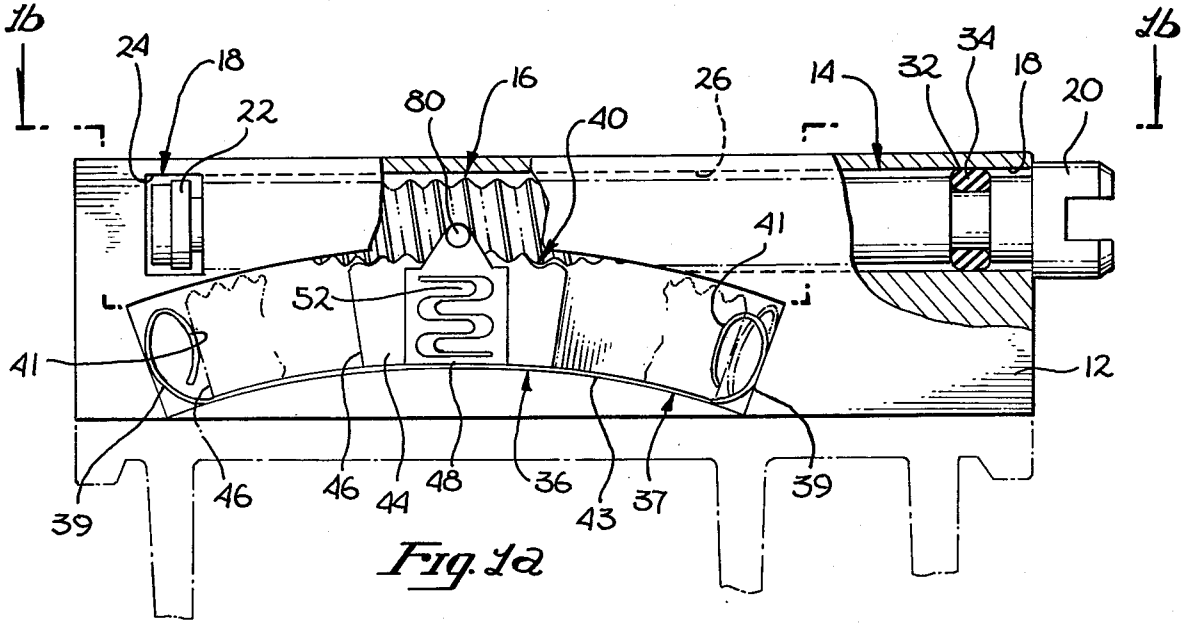
FIG. 1*a* is a side view of the upper housing member taken through Section 1—1 of FIG. 7 and shows the worm screw, gear sector wiper and spring.
Figure 7:
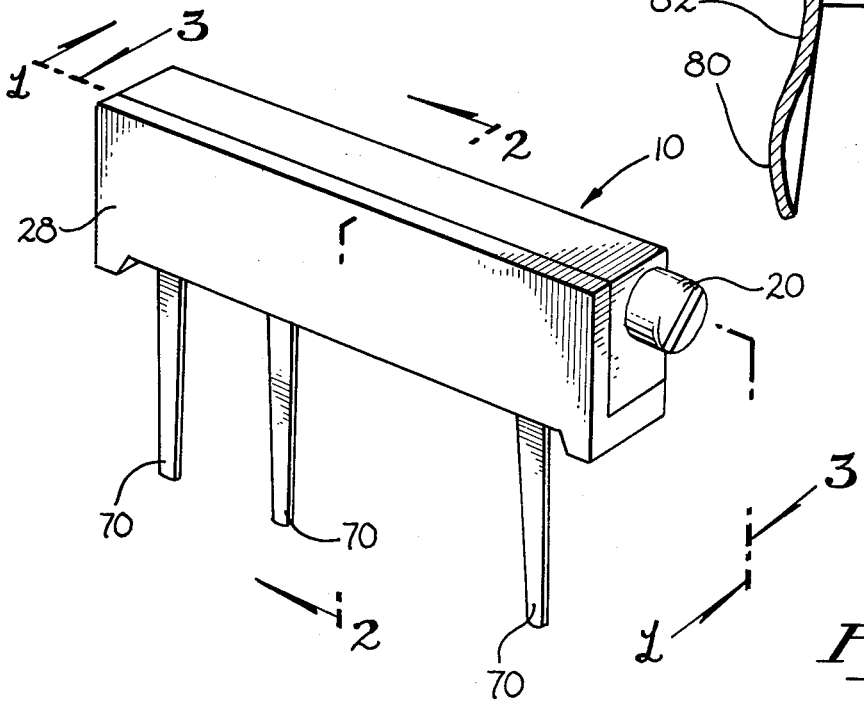
FIG. 7 is a prespective view of the assembled rectangular potentiometer.

In FIG. 1*a*, a plan view of an upper housing member 12 is illustrated as shown through Section 1—1 of the potentiometer 10 of FIG. 7. A housing body 28 may be further comprised of upper housing member 12 and a lower housing member 30 shown in greater detail in FIG. 3. An elongated screw 14 is rotatably disposed in upper housing member 12. Elongated screw 14 may have a worm screw section 16, one or more bearing sections 18 and an adjustment head 20. At the bearing end 18 distal from adjustment head 20, a resilient washer 22 may be disposed upon screw 14 within upper housing 12. Resilient washer 22 may be slip fit over end 18 or coupled thereto in any manner well known to the art. In the embodiment illustrated, bearing end 18 is disposed within a slightly enlarged receiving cavity 24 formed within upper housing member 12. Resilient washer 22 then has a slightly greater diameter than axial bore 26 in which screw section 16 of elongated screw 14 is disposed. By this means, or any other equivalent means, known in the art, elongated screw 14 may be rotatably fixed within housing body 28 (shown as FIG. 7). A necked portion 32 may be formed in elongated screw 14 in order to provide a receiving surface for a resilient O-ring washer 34. The O-ring washer 34 is disposed in necked portion 32 and provides a tight seal between elongated screw 14 and upper housing member 12. Washer 34 performs the dual function of centering and sealing the interior of potentiometer 10 from moisture and other environmental agents which may otherwise enter the potentiometer through axial bore 26, and it additionally provides a small frictional drag together with washer 22 against the rotation of elongated screw 14. Thus, screw 14 may be rotated to a selected position and will retain this position without drifting due to minor influences of unforeseen stresses or vibration. The end of screw 14 is configured to form an adjustment head 20 which is illustrated as being a simple slot crew head well known to the art. Many other forms may be assumed by adjustment head 20 including hexagonal heads, square heads, socket heads, and many other well known forms.

Worm screw section 16 of screw 14 is shown in FIG. 1 as engaged with a gear sector 36. Gear sector 36 is shown as disposed in an arcuate carriage slot 38 formed in upper housing member 12. Gear sector 36, which may be resilient, is shown as disposed in arcuous slot 38 formed in upper housing member 12. Gear sector 36 is illustrated in solid outline in the central portion of carriage slot 38. The end portion of gear sector 36 is shown in phantom outline in its two extreme positions in carriage slot 38. Gear sector 36 contacts or engages a spring 37 in each extreme position. The upper portion of gear sector 36 forms a plurality of gear teeth 40 which are matched to and engage worm screw section 16 of screw 14. Generally, several of the plurality of gear teeth 40 are enmeshed with screw section 16 at any given position of gear sector 36 within carriage slot 38. This feature provides for a positive action and reduces lead lag. Gear sector 36, including gear teeth 40 may be comprised of a high temperature resilient plastic such as glass filled nylon which has sufficient regidity to permit positive engagement with worm screw section 16 and yet permits a degree of deformability. Many other materials well known to the art may be employed and other embodiments in variations of gear sector 36 may be chosen including rigid gear sectors. For example, it is within the scope of the present invention that gear sector 38 be composed of a plurality of stratified layers such that gear teeth 40 may be formed in a layer of semiflexible material in comparison to the remaining portions of gear sector 36. In the illustrated embodiment gear sector 36 is of a single type of material. It should be noted that since gear sector 36 is of a nonconductive material, no special precaution need be taken to insulate screw 14 from the remaining elements of the potentiometer. Screw 14 is automatically insulated by design. If gear sector 36 is of a resilient material, gear teeth 40 may be made slightly oversize to fit tightly and deform slightly against rigid worm screw section 16 of screw 14. In this manner, lead lag is further reduced.

Figure 1B:
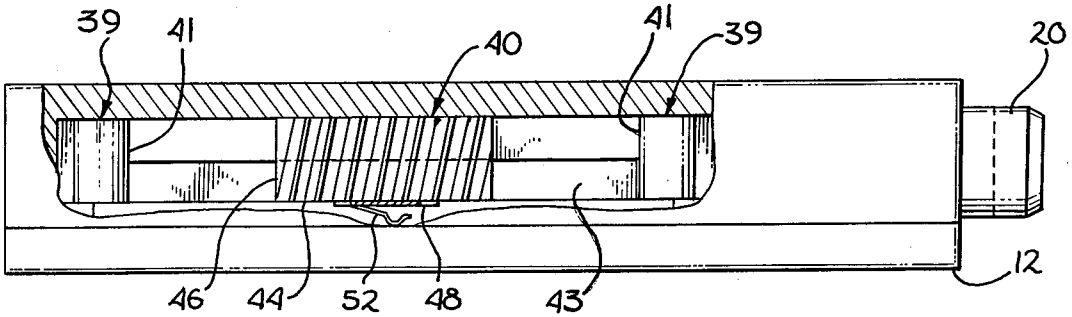
FIG. 1*b* is a plan view of the upper housing member taken through Section 1*b*—1*b* of FIG. 1*a*.

In the embodiment of FIGS. 1*a* and 1*b* spring 37 is an integral member comprised of thin, resilient metal well known to the art. Spring 37 has symmetric end portions 39 shaped in the form of a leaf spring type configuration. Element 41 contacts or engages sector gear 46 when disposed in its extreme positions as shown in phantom outline in FIG. 1*a*. An interlying section 43 of spring 37 extends between portions 39 along arcuate carriage slot 38. As shown in FIG. 1*b* interlying section 43 is reduced in width between portions 39 so that metallic wiper 48 cannot make contact and cause undesired shorts. The offset between wiper 48 and interlying section 43 is more clearly illustrated in cross section in FIG. 2.

As a result of the use of spring 37, a clutch mechanism is achieved which has positive action, greater sureness of response and longer lifetimes than in the case where only the resiliency of sector gear 46 is employed. In addition, construction is simplified and ruggedized by the unitary spring which tends to snap fit into arcuate carriage slot 38, thereby rendering the use of cements or epoxies unnecessary during assembly.

The operation of gear sector 36 with respect to carriage slot 38, spring 37 and screw 14 within upper housing member 12 may be understood as follows. Carriage slot 38 is formed in an arcuate path, typically having a single radius of curvature. The sectorial angle which gear sector 38 subtends with respect to the center of curvature may be chosen to be slightly in excess of one-half of the sectorial angle subtended by carriage slot 38. For example, if carriage slot 38 subtends a 40° angle, gear sector 36 as shown in FIG. 1 may subtend an angle of 21°. However, the angle subtended by the plurality of gear teeth 40 may only be 16.5°. Screw 14 may engage gear sector 36 only along an 8° arc centered on carriage slot 38. Thus, as gear sector 36 is driven to the extreme position and tends to drop away from screw 14 the last engaged gear teeth 40 of gear sector 36 are advanced only by a distance equal to or less than the pitch of screw section 16 of screw 14. As gear sector 36 is driven toward its extreme position, it is driven down the curved length of carriage slot 38 and is disengaged from worm screw section 16. To a certain extent the deformability of gear teeth 40, if any, as well as the body and overall configuration of gear sector 36 facilitate this disengagement by deforming slightly as the threading of screw 14 advances. As screw 14 continues to rotate the resiliency of spring 3 will urge gear teeth 40 back into engagement with screw section 16. The following edge of the threading will engage at least the last tooth of gear teeth 50 which will again be advanced by the pitch of screw section 16 until forced out of engagement by reason of the confinement of gear sector 36 within curved carriage slot 38. Thus, as screw 14 continues to rotate after gear sector 36 assumes its extreme position within carriage 38, gear sector 36, and gear teeth 40 will begin to effect a racheting motion with a displacement of the order of the magnitude of the pitch of screw section 16. When the rotation of screw 14 is reversed, the resiliency of spring 37 will urge gear teeth 40 into engagement with worm screw section 16 and will drive gear sector 36 along carriage slot 38 toward the opposing extreme position. In this manner, a positive acting squeeze or compression clutch is automatically actuated to disengage gear sector 36 from screw 14 according to the position of gear sector 36 and the sense of rotation of screw 14.

Figure 2:
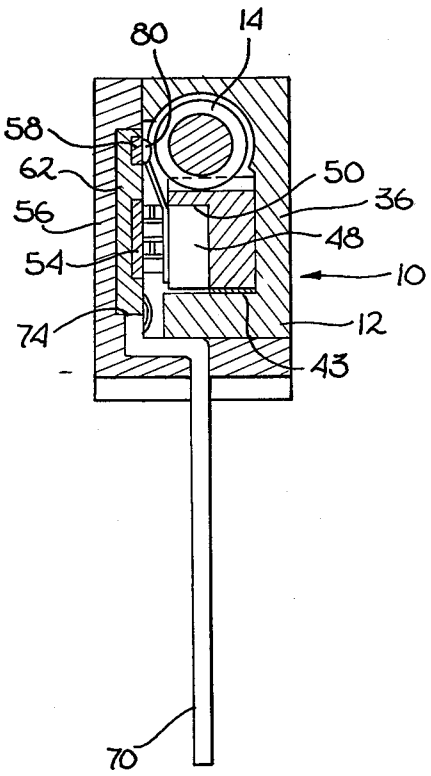
FIG. 2 is a cross section of the present invention taken through Section 2—2 of FIG. 7.
Figure 4:
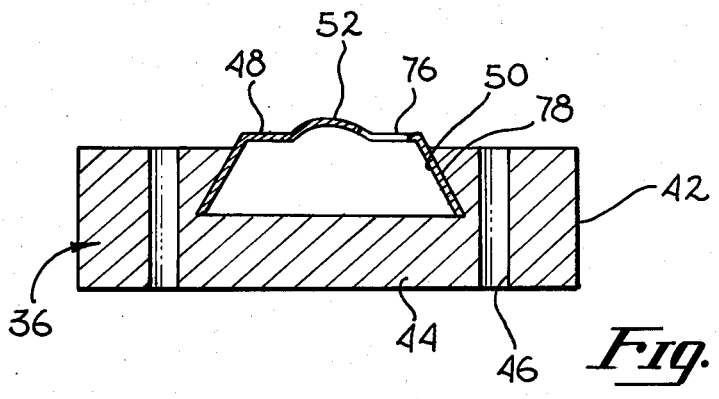
FIG. 4 is a cross section of the resilient sector gear showing the wiper disposed therein.

Wiper 48 is fixed to gear sector 36 as shown in greater detail in FIGS. 2 and 4. In particular, in FIG. 2, gear sector 36 is shown as disposed in carriage slot 38 within upper housing member 12 and as having wiper 48 set within a receiving well 50 formed in gear sector 36. Wiper 48 has a plurality of fingers 52, as described in greater detail below, extending from the body of the wiper to a resistance element 54 formed within lower housing member 56. Any means well known to the art by which wiper 48 may be fixed to gear sector 36 may be employed. However, in the embodiment illustrated gear sector 36 is arranged and configured so that substantially all the deformation of gear sector 36 is taken up by the narrowing of slot 46 and the deformation of cantilevered projection 42. Substantially no stresses are then exerted against wiper 48 when gear sector 36 is driven into either one of the extreme positions within carriage slot 38. Thus, even if screw 14 is driven violently to and past its extreme settings, substantially no stress is exerted against wiper 48. Thus, wiper 48 is never exposed to the possibility of permanent damage.

Figure 3:
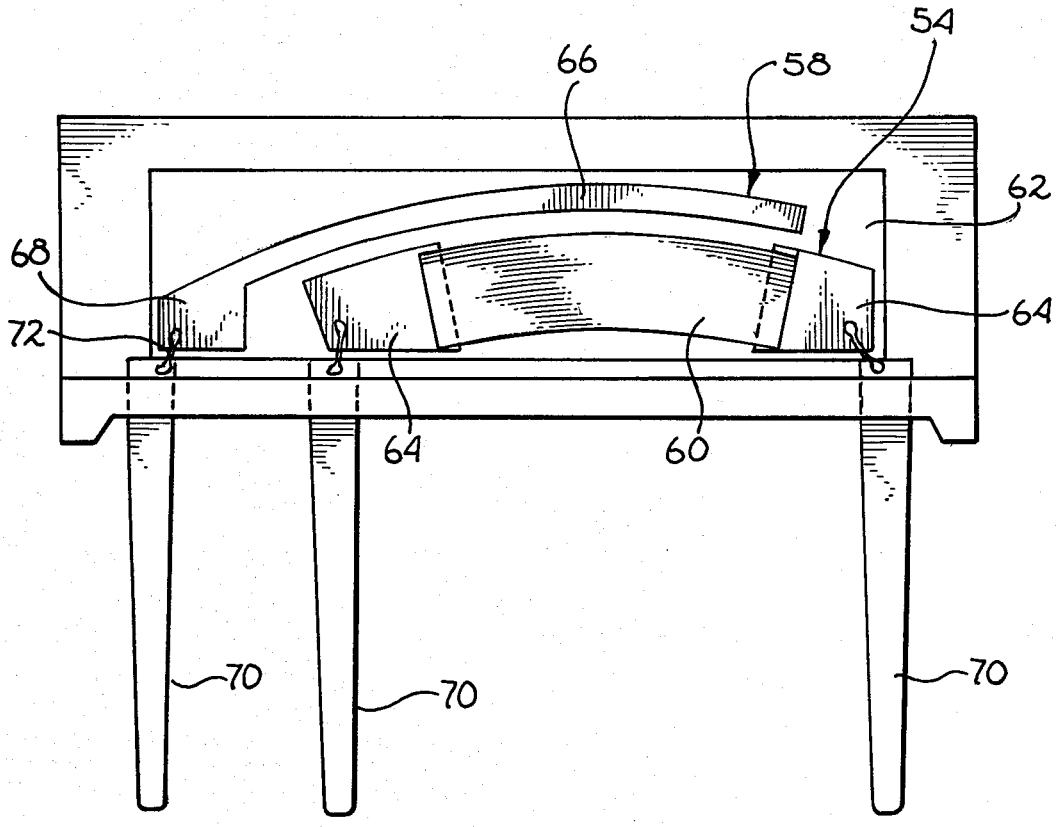
FIG. 3 is a plan view of the lower housing member showing the conductive and resistive elements.

FIG. 3 illustrated in plan view of lower housing member 56 and shows resistance element 54 in greater detail. Resistance element 54 is shown as being comprised of a resistive layer 60 disposed on an insulating substrate 62 in combination with conductive contacts 64. Many types of resistance elements may be employed and the present embodiment illustrates by way of example only, a thick film layer of cermat 60 disposed on an alumina substrate 62 and terminating at each end in a gold-palladium contact 64. Similarly, conductive element 58 is disposed upon substrate 62 in a generally parallel and overlapping relationship with resistance element 54. Conductive element 58 is characterized by having a wiper portion 66 which is adjacent and parallel to resistive layer 60 and which is coupled to a contact portion 68. An conductive material known to the art may be used to form conductive element 58 and in the present embodiment a gold-palladium paste is selectively disposed on substrate 62 and treated by well known means to form a thick durable film layer. External lead 70, which may be molded or otherwise fixed within housing body 28, is coupled to conductive element 58 and resistance element 54. One external lead 70 is coupled to each conductive contact 64 and the remaining external lead 70 is coupled to contact portion 68 of conductive element 58. External leads 70 may be coupled by any means well known to the art to resistance element 54 and conductive element 58. For example, external leads 70 may be coupled to resistance element 54 and conductive element 58 by means of small wires 72 soldered between contact portions 68 and 64 and external leads 70. Many other embodiments may be possible including the extension of conductive contacts 64 and 68 beyond and over the edge of substrate 62 to contact the end portion of external lead 70 as it extends into a receiving well 74 which encloses substrate 62.

The disposition of wiper 48 within gear sector 36 can be more clearly understood by viewing the cross section of FIG. 4. Wiper 48 is shown in cross section as comprised of fingers 52, frame member 76 from which fingers 52 extend, and base 78. Base 78 extends within receiving well 50 and forms a snug, tight fit by reason of the elastic compression provided by wiper 48. Greater structure detail of wiper 48 can be seen in FIGS. 5 and 6.

Figure 5:
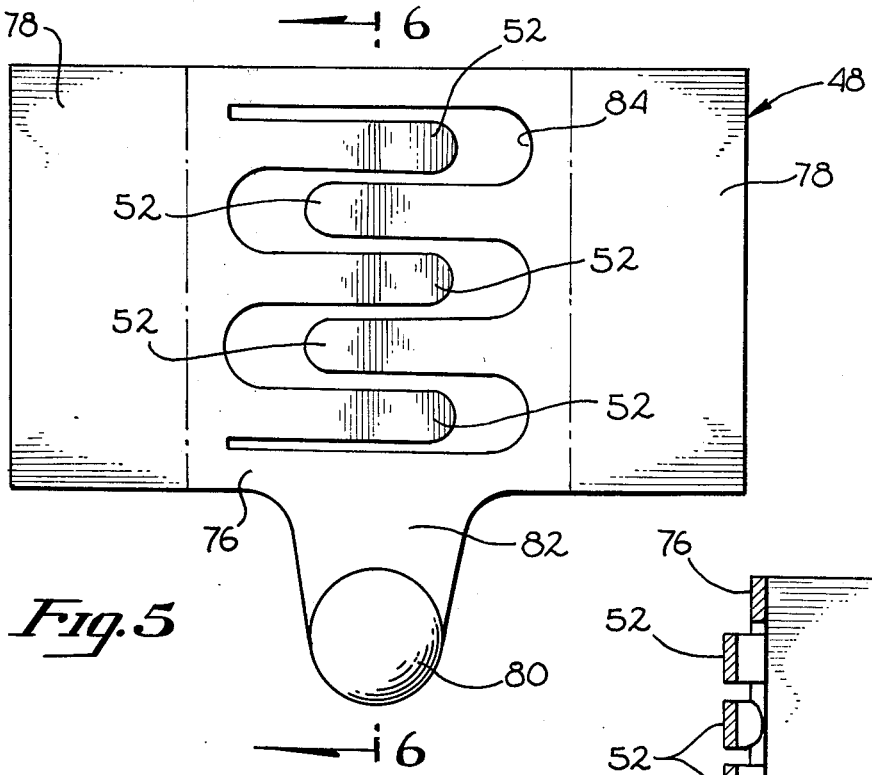
FIG. 5 is a plan view of the wiper showing the conductive member and the interdigitated opposing fingers.

The interdigitated opposing pattern of fingers 52 shown in FIG. 5 are of particular advantage in providing a uniform acting, low noise electrical contact with resistance layer 60. The configuration of fingers 52 is substantially symmetric with respect to the direction of translation and provide for uniform mechanical action and electrical contact. Each of the fingers are electrically in parallel such that at any given instant the probability of one of the plurality of fingers making intimate electrical contact with resistive layer 60 is extremely high. In addition, the opposing pattern provides for uniformity of mechanical action in each direction of motion of wiper 48 across resistive layer 60.

Figure 6:
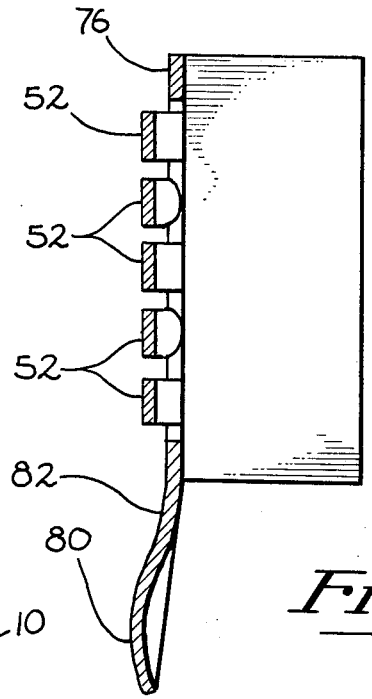
FIG. 6 is a cross section of the wiper taken through Section 6—6 of FIG. 5.

In FIG. 5 wiper 48 is shown in plan view. Frame member 76 provides a base for a plurality of opposing interdigitated fingers 52. In the embodiment illustrated, frame member 76 provides a planar base. Rounded edges 84 are formed to increase the strength of attachment at the coupling between each finger 52 and frame member 76. Fingers 52 are shown in an opposing overlapping relationship and provide a compact assembly of interdigitated contact fingers. As shown in FIG. 6, fingers 52 extend from the plane defined by frame member 76 and span the distance between gear sector 36 and resistive element 54. Fingers 52 are held in electrical contact with resistive layer 60 by means of elastic compression due to the resiliency of fingers 52. Frame member 76 is also formed into an extension which terminates into a dimpled contact 80 shown in FIGS. 5 and 6. Dimpled contact 80 similarly extends from gear sector 36 in upper housing member 12 to wiper contact portion 66 of conductive element 58. Dimpled contact 80 is kept in contact with wiper contact portion 66 by means of elastic compression arising in part from extension 82. Wiper 48 is typically formed of an integral sheet of metal which is bent and cut to shape as described and may be composed of a phosphor bronze alloy or any other suitable contact material known to the art.

The constituent elements of the present invention, as described above, are assembler in the upper and lower housing members to form a single housing body 28 as shown in FIG. 7. Each half of housing body 28 may be bonded by means of adhesive, thermal bonding, or any other means well known to the art. Although the present invention has been described as being fabricated in a two part housing body, any means of packaging well known to the art, such as molding or casting, may be employed.

Although the present invention has been described in connection with a specific embodiment, many alterations and modifications, which may be made by those in ordinary skill in the art, are contemplated and are within the spirit and scope of the present invention.

I claim:

1. A potentiometer comprising:
a housing;
a resistance element disposed within said housing;
a conductive element disposed within said housing;
an elongated screw rotatably disposed within said housing;
a sector gear slideably disposed in said housing along an arcuate path and being adapted to engage said elongated screw;
a conductive wiper fixed to said sector gear and being in sliding contact with said resistance and conductive elements; and
a resilient spring disposed in said housing and engaging said sector gear at the extremes of travel of said sector gear.

2. The potentiometer of claim 1 wherein:
said elongated screw is a worm screw; and said sector gear is a resilient worm drive sector gear.

3. The potentiometer of claim 1 wherein said conductive wiper is fabricated in an integral piece and includes:
a conductive member in slideable contact with said conductive element; and
a plurality of interdigitated, opposing fingers in slideable contact with said resistance element, each of said plurality of interdigitated, opposing fingers corresponding to an oppositely disposed finger, the elastic compression of said conductive member and finger holding said member and finger in functional disposition within said potentiometer.

4. The potentiometer of claim 1 wherein said resilient spring is a single compressible leaf spring.

5. The potentiometer of claim 2 wherein said sector gear is disposed into an arcuate carriage slot formed in said housing, said carriage slot confining said sector gear to travel therein.

6. A potentiometer having a housing body and an arcuate resistance element having a first and second conductive terminal extending from said housing body, said resistance element disposed in said housing body, said potentiometer comprising:
an arcuate conductive element disposed in said housing body in a substantially parallel configuration with respect to said resistance elements, and having a terminal extending from said housing body;
a worm screw rotatably disposed in said housing body;
an arcuate carriage slot having closed ends and formed in said housing body and disposed in a generally overlying relationship with respect to said arcuate resistance and conductive elements, said arcuate carriage slot subtending a preselected sectorial angle with respect to the center of curvature of said arcuate carriage slot;
a resilient leaf-type compression spring disposed in said arcuate carriage slot;
a sector gear slideably disposed in said arcuate carriage slot, being confined therein and being adapted to engage said worm screw, said sector gear assuming a first and second extreme disengaged position within said arcuate carriage slot and contacting said resilient leaf-type compression spring, said sector gear being urged into re-engagement with said worm screw by said resilient leaf-type compression spring and engaging means; and
a conductive wiper fixed to said resilient sector gear and being in simultaneous sliding contact with said resistance and conductive elements.

7. The potentiometer of claim 1 wherein said conductive wiper is fabricated as an integral piece and includes:
a conductive member in slideable contact with said conductive element; and
a plurality of interdigitated, opposing fingers in slideable contact with said resistance element, each of said plurality of interdigitated, opposing fingers corresponding to an oppositely disposed finger, the elastic compression of said conductive member and finger holding said member and finger in functional disposition within said potentiometer.

* * * * *